US012774643B2

(12) United States Patent
Keihany et al.

(10) Patent No.: US 12,774,643 B2
(45) Date of Patent: Oct. 27, 2026

(54) SAND AND GAS QUANTIFICATION AND AUTOMATED CONTROL OF FLOWBACK OPERATIONS

(71) Applicant: FMC Technologies, Inc., Houston, TX (US)

(72) Inventors: Julian Keihany, Houston, TX (US); Ryan Malone, Farmington, NM (US); Eric Rasmussen, Gordon, TX (US); Tommy Thammavongsa, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 13 days.

(21) Appl. No.: 19/012,545

(22) Filed: Jan. 7, 2025

(65) Prior Publication Data

US 2026/0193950 A1 Jul. 9, 2026

(51) Int. Cl.
*E21B 21/06* (2006.01)
*E21B 21/08* (2006.01)

(52) U.S. Cl.
CPC ..... *E21B 21/066* (2013.01); *E21B 21/08* (2013.01)

(58) Field of Classification Search
CPC ..... E21B 21/065; E21B 21/066; E21B 21/08; E21B 21/10
See application file for complete search history.

(56) References Cited

U.S. PATENT DOCUMENTS

| | | | | |
|---|---|---|---|---|
| 4,737,168 | A * | 4/1988 | Heath | C07C 7/00 95/260 |
| 8,424,599 | B2 | 4/2013 | Atencio | |
| 2014/0345727 | A1* | 11/2014 | Gilmore | E21B 34/025 137/624.21 |
| 2015/0322783 | A1* | 11/2015 | Rowe | G01N 33/225 175/42 |
| 2021/0252431 | A1 | 8/2021 | Malone et al. | |
| 2022/0170351 | A1 | 6/2022 | Ahmari | |
| 2022/0357719 | A1 | 11/2022 | Stout et al. | |
| 2023/0009998 | A1* | 1/2023 | Subotic | E21B 47/20 |
| 2023/0313660 | A1* | 10/2023 | Ellis | E21B 43/35 |
| 2023/0383646 | A1 | 11/2023 | Yip et al. | |

OTHER PUBLICATIONS

PCT Patent Application PCT/US2026/10111 International Search Report and Written Opinion of the International Searching Authority issued Apr. 21, 2026.

* cited by examiner

*Primary Examiner* — Kristyn A Hall
(74) *Attorney, Agent, or Firm* — Erise IP, P.A.

(57) ABSTRACT

Systems and methods for quantifying sand and gas discharge in a sand discharge cycle and controlling a sand evacuation process of an oil and gas well system is disclosed. Sensors including at least pressure transducers and a density meter may be disposed along a discharge line and configured to detect data indicative of the flow of a discharge fluid in the discharge line. The data may be analyzed to determine a pressure differential across a discharge control valve and a density of the discharge fluid. Furthermore, a discharge fluid flowrate, a discharge volume, a discharge sand weight, and a gas discharge quantity may be estimated. Open amount and time settings of the discharge control valve may be adjusted for the next evacuation cycle based on the weight of the discharged sand and the gas discharge quantity.

20 Claims, 7 Drawing Sheets

SAND AND GAS QUANTIFICATION AND AUTOMATED CONTROL OF FLOWBACK OPERATIONS

BACKGROUND

1. Field

Embodiments of the current disclosure relate to flowback control in oil and gas well systems. More specifically, embodiments of the current disclosure relate to systems and methods of sand and gas quantification and automated evacuation control.

2. Related Art

Typically, when an oil and gas well is initially opened, sand is expelled from the well. The sand may be naturally occurring deposits in the well and/or sand that was forced into the well in a hydraulic fracturing ("fracking") procedure. When the well is opened, fluid including the sand is expelled due to the well pressure. The sand must be separated from the fluid before oil and gas can be produced. Typically, a sand separator can be used to separate the sand from the fluid. As the sand is separated in the sand separator, the sand builds up and must be moved, "dumped," or, as referenced herein evacuated to a storage container. Periodically, the sand separators are evacuated using the well pressure and fluid from the well to force the sand from the sand separator to the storage container. However, there are several drawbacks to this process. Standard sand evacuation techniques are performed by an operator operating a series of valves at their own discretion based on their own experience and/or on a set schedule. Currently, operators may weigh the sand evacuated from the sand separator to determine a sand quantity then open and close valves based on the sand quantity and/or the set schedule. This process is inefficient and generally not based on up-to-date data indicative of the state of the sand in the system. Typical current sand evacuation procedures are a manual and subjective process.

Also, in typical processes, the pressure from the well is used to evacuate the sand from the sand separator. Therefore, the sand may flow quickly at high pressure through the discharge system to the storage container. Typically, the storage container is an open top tank, which is opened to the atmosphere. When the sand has been evacuated, gases from the well are expelled into the atmosphere. The gases from the well are typically methane and volatile organic compounds (VOC). As it is undesirable to emit these gases into the atmosphere, when opening the well to the atmosphere, it is desirable to maintain strict control of the fluids released. Therefore, leaving sand evacuation to operator discretion is not optimal.

Furthermore, at high pressures, sensors cannot be used in the piping as the pressures are too high. For example, flow meters, temperature sensors, and the like, have pressure limits. Furthermore, as the fluid flows through the piping at high speeds, the abrasive sand included in the fluid damages sensors disposed in the flow. Therefore, the high well pressure and the abrasive flow results such that sensors cannot be used inside the discharge piping.

What is needed are systems and methods of quantifying sand discharge and volume flowrate in sand evacuation cycles for optimally and automatically adjusting valves to control future evacuation cycles. Furthermore, what is needed, are systems and methods of quantifying and controlling gas expulsion from the discharge line.

SUMMARY

Embodiments of the current disclosure solve the above-described problems and provide a distinct advance in the art by providing systems and methods of quantifying sand discharge during a sand evacuation cycle and controlling the flow of discharge fluid based on the sand quantity.

An embodiment of the current disclosure comprises an automated sand evacuation system for automatically controlling flow of discharge fluid in a discharge line of an oil and gas well system. The automated sand evacuation system comprises a plurality of interconnected pipes configured to move sand from a sand separating vessel to a storage container, a discharge control valve configured to allow the discharge fluid including the sand to flow through the plurality of interconnected pipes to the storage container when open and prevent the sand from flowing when closed, a plurality of sensors configured to detect parameters indicative of the discharge fluid in the discharge line, and one or more non-transitory computer-readable media storing computer-executable instructions that, when executed by at least one processor, perform a method of quantifying the sand in an evacuation cycle and controlling the flow of the discharge fluid. The method comprises obtaining the parameters from the plurality of sensors, determining a flowrate of the discharge fluid based on the parameters, determining a discharge volume of the discharge fluid based on the flowrate, determining a discharge sand quantity discharged during the evacuation cycle based on the discharge volume and changes in a discharged fluid density, adjusting a position setting and a time setting for the discharge control valve based at least in part on the discharge sand quantity, and controlling the discharge control valve based on the position setting and the time setting.

An embodiment of the current disclosure relates to a method of quantifying sand in an evacuation cycle and controlling flow of a discharge fluid in an oil and gas well system. The method comprises obtaining, from a plurality of sensors, parameters indicative of the discharge fluid flowing in a discharge line, wherein the plurality of sensors comprises a first pressure transducer disposed upstream of a discharge control valve; and a second pressure transducer disposed downstream of the discharge control valve. The method further comprises determining a pressure differential between a first pressure measured by the first pressure transducer and a second pressure measured by the second pressure transducer, determining a flowrate of the discharge fluid based on the parameters and the pressure differential, determining a discharge volume of the discharge fluid based on the flowrate, determining a discharge sand quantity discharged during the evacuation cycle based on the discharge volume, adjusting a position setting and a time setting for the discharge control valve based at least in part on the discharge sand quantity, and controlling the discharge control valve based on the position setting and the time setting.

An embodiment of the current disclosure relates to an automated sand evacuation system for automatically controlling sand and gas discharge of an oil and gas well system. The automated sand evacuation system comprises a plurality of interconnected pipes including a discharge line configured to move the sand from a sand separating vessel to a storage container, a plurality of valves including a discharge control valve configured to allow a discharge fluid including the sand to flow through the plurality of interconnected pipes to the storage container when open and prevent the discharge fluid from flowing when closed, a plurality of sensors configured to detect fluid parameters indicative of the discharge fluid, a plurality of gas detecting sensors disposed at the storage container and configured to detect gas parameters indicative of the gas discharge from the discharge line, and one or more non-transitory computer-readable media storing computer-executable instructions that, when executed by at least one processor, perform a method of controlling flow of the discharge fluid. The method comprises obtaining the fluid parameters and the gas parameters from the plurality of sensors, determining a discharge sand quantity discharged from the discharge line into the storage container, determining a gas discharge quantity discharged from the discharge line, and controlling the discharge control valve based on the sand quantity and the gas discharge quantity.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1:
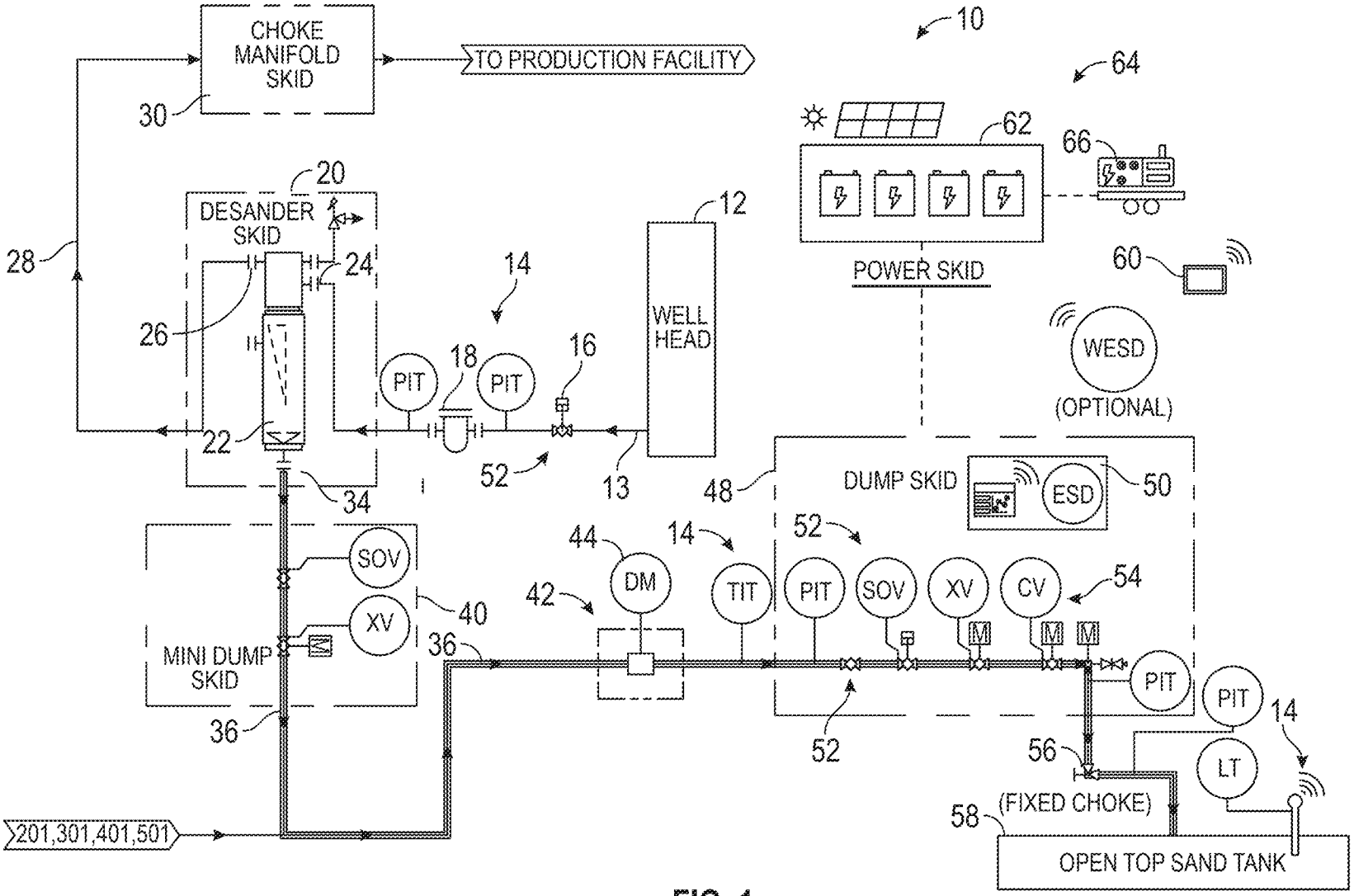
FIG. 1 depicts a schematic of an exemplary oil and gas well sand evacuation system.

The drawing figures do not limit the invention to the specific embodiments disclosed and described herein. The drawings are not necessarily to scale, emphasis instead being placed upon clearly illustrating the principles of the invention.

DETAILED DESCRIPTION

The following description of embodiments of the invention references the accompanying illustrations that illustrate specific embodiments in which the invention can be practiced. The embodiments are intended to describe aspects of the invention in sufficient detail to enable those skilled in the art to practice the invention. Other embodiments can be utilized, and changes can be made without departing from the scope of the invention. The following detailed description is, therefore, not to be taken in a limiting sense.

In this description, references to "one embodiment", "an embodiment", "embodiments", "various embodiments", "certain embodiments", "some embodiments", or "other embodiments" mean that the feature or features being referred to are included in at least one embodiment of the technology. Separate references to "one embodiment", "an embodiment", "embodiments", "various embodiments", "certain embodiments", "some embodiments", or "other embodiments" in this description do not necessarily refer to the same embodiment and are also not mutually exclusive unless so stated and/or except as will be readily apparent to those skilled in the art from the description. For example, a feature, structure, act, etc., described in one embodiment may also be included in other embodiments but is not necessarily included. Thus, the current technology can include a variety of combinations and/or integrations of the embodiments described herein.

Generally, embodiments of the current disclosure provide systems and methods for quantifying sand flowing in a discharge line of interconnected pipes of an oil and gas well evacuation cycle and controlling the flow of the discharge fluid. In some embodiments, sand may be removed from an oil and gas well fluid by a sand separator vessel. Periodically, the sand in the sand separator vessel should be removed from the sand separator vessel and deposited into a storage container. To remove the sand, the well may be opened providing pressure and fluid from the well to evacuate the sand from the sand separator vessel. A discharge control valve may be operated to control the flow of the discharge fluid from the sand separator vessel to the storage container. In some embodiments, various sensors may be placed along the discharge line to detect various parameters of the discharge fluid. For example, a density meter may measure a density of the discharge fluid and pressure transducers may measure pressures of the discharge fluid at various locations. More specifically, pressure transducers may be placed before and after the discharge control valve, and a differential pressure across the discharge control valve may be calculated. The differential pressure and the density of the discharge fluid may be used to determine discharge flow rate, discharge volume, and discharge sand quantity (e.g., pounds of sand) for the evacuation cycle. As such, an amount of sand discharged from the sand separator vessel to the storage container may be estimated during the evacuation cycle.

Furthermore, in some embodiments, the discharge control valve may be controlled based on the flow rate, the discharge volume, and/or the discharge sand quantity as well as any other parameters associated with a state of the discharge fluid. As the state of the discharge fluid is known, the discharge control valve can be controlled to maximize the sand discharge while minimizing an amount of gas expelled into the atmosphere at the storage container. For example, if the discharge control valve is opened too much and/or for too long for a particular evacuation cycle, excess gas from the well may be expelled into the atmosphere. Expelling gas from the well is inefficient and releases methane and VOC into the atmosphere. Strictly controlling the discharge control valve based on the measured and calculated state of the discharge fluid and the amount of sand evacuated in the evacuation cycle allows adjustments to be made that maximize the sand quantity discharge and minimizes the gas discharge over the evacuation cycle.

Furthermore, updates to evacuation cycles and times may be performed based on the results of each evacuation cycle. Each sand evacuation cycle may be analyzed to determine a quantity of sand that was deposited into the storage container and an amount of gas that was expelled into the atmosphere. Based on comparing an expectation versus reality of the previous evacuation cycle, a discharge control valve position and expected duration of the discharge control valve can be determined for the next evacuation cycle. Furthermore, a time between evacuation cycles may be adjusted based on the previous cycle results. In some embodiments, real-time control of the discharge control valve or the choke manifold skid may be updated based on the results of previous evacuation cycles and real-time measurements.

FIG. 1 depicts a schematic of an exemplary piping and instrumentation (P&ID) system ("system 10"). In some embodiments, system 10 comprises actuators, valves, interconnected piping, instrumentation, and computing components configured to automate the control of sand evacuation cycles disclosed herein. In some embodiments, system 10 comprises wellhead 12. Wellhead 12 may be any general wellhead representing the entrance and control of well piping leading to a standard oil and gas well production facility. Wellhead 12 may comprise valves and control elements for controlling access to the well. Initially, when wellhead 12 is connected to the well and wellhead 12 is opened, well fluid comprising sand may be expelled from the well. The sand may be part of natural materials in the well prior to drilling and/or can be added to the well by a hydraulic fracturing (i.e., "fracking") procedure. In any case, the sand should be expelled from the well before the oil and gas can be obtained and provided to production lines 28 and eventually to the production facility.

As the well fluid comprising the sand is expelled from the well through wellhead 12, the well fluid enters the first set of piping comprising various valves 52 and sensors 14. Valves 52 and sensors 14 may be disposed between wellhead 12 and desander skid 20. Valves 52 may comprise shutoff valves, choke valves, and the like, and may be operated to control the flow of the well fluid. Here and elsewhere, sensors 14 may be configured to detect various parameters such as, for example, fluid density, pressures, flow rates, and the like.

As shown, emergency shutoff valve 16 and strainer 18 are disposed between wellhead 12 and sand separator vessel 22. Emergency shutoff valve 16 may be configured to shut off the flow from wellhead 12. Strainer 18 may be configured to remove large impurities from the well fluid. For example, strainer 18 may comprise a mesh configured to remove impurities as large as and larger than 40 microns. However, the size of the mesh and the size of the impurities removed by the mesh may be selected based on the desired sand size entering sand separator vessel 22. Furthermore, exemplary pressure transducers (PIT) are shown. Here, pressure transducers may be disposed in the first set of piping to measure a pressure from the wellhead 12. Furthermore, pressure transducers may be disposed on each side (upstream and downstream) of strainer 18 to determine a differential pressure across strainer 18. Any sensors 14 described herein may be disposed between wellhead 12 and sand separator vessel 22 as well as at any other location in system 10 to obtain data indicative of volume flowrate and sand quantity at any point in system 10.

Though illustrated as being disposed along discharge line 36, density meter mounting skid 42 comprising density meter 44 may also be disposed between wellhead 12 and sand separator vessel 22 along wellhead line 13. Here, various parameters may be detected and/or calculated based on sensor output such as, for example, fluid density, temperature, pressure, vibrations, flowrate, and the like. In some embodiments, the parameters may be used to determine an amount of sand and/or fluid entering sand separator vessel 22. As described below, parameters indicative of the fluid and sand before entering sand separator vessel 22 may be used with output parameters measured and calculated after exiting sand separator vessel 22 to determine sand weight as well as volume discharge amount and flowrates as described in embodiments below.

Furthermore, in some embodiments, density meter mounting skid 42 comprising density meter 44 may be positioned anywhere along production line 28. Here, density meter 44 may detect the density of the fluid passing from desander skid 20 to choke manifold skid 30 and on to the production facility. Furthermore, as describe in embodiments below, various sensors 14 including pressure sensors may be positioned on an upstream side and a downstream side of the choke manifold of choke manifold skid 30. A pressure differential may be measured/calculated across the choke manifold, and, in some embodiments, the choke manifold may be controlled based on the determined fluid flow volume and fluid composition determined from the sensor data obtained by sensors 14. In some embodiments, control of discharge control valve 54 may also utilize inputs from the flow characteristics and flow composition measured along production line 28 and/or, as described above, between wellhead 12 and desander skid 20 along wellhead line 13.

Figure 2:
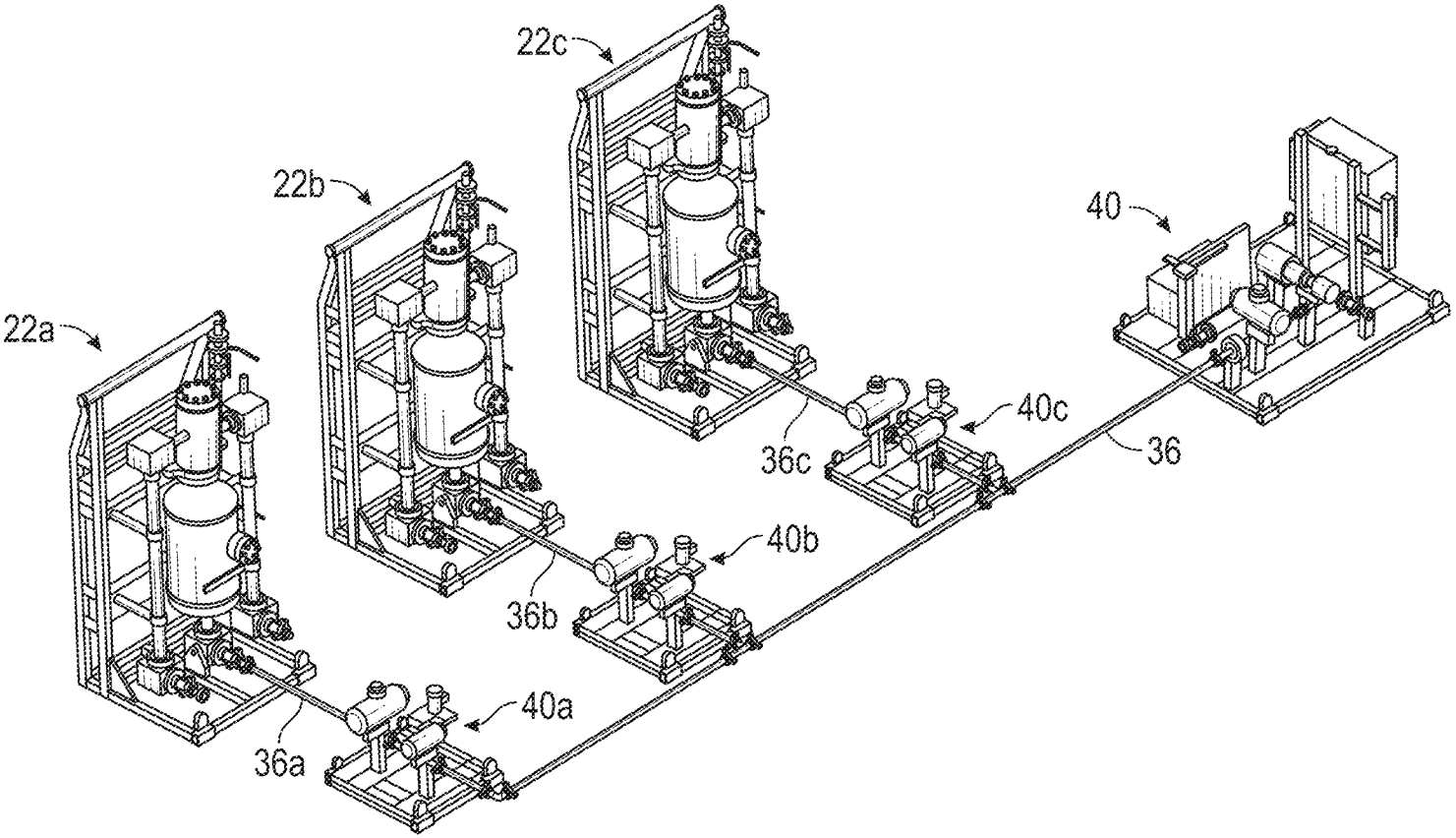
FIG. 2 depicts an exemplary sand separator system for some embodiments of the disclosure.

The output from wellhead 12 may comprise well fluid mixed with sand ejected from the oil and gas well. Well fluid may enter sand separator vessel 22 at sand separating vessel inlet 24. Here, sand separator vessel 22 may be any sand separating vessel in the industry. Furthermore, as illustrated in FIG. 2 and described in more detail below, sand separator vessel 22 may be a plurality of sand separator vessels 22*a*, 22*b*, 22*c* (FIG. 2) receiving well fluid from a plurality of wells (not shown). As the well fluid mixture is received into sand separator vessel 22 at sand separating vessel inlet 24, the well fluid may be forced into a vortex forcing the sand downward into a lower accumulator section of the sand separator vessel 22 and forcing the fluid out of production outlet 26. Therefore, the sand is separated from the fluid by sand separator vessel 22. The sand may settle in the lower accumulator section of sand separator vessel 22 and periodically, the sand must be removed in the below described sand removal operation, "dump cycle," or, as referenced herein, the sand evacuation cycle. Furthermore, once the sand has been cleared from the well, the well fluid can be directed to the production facility by production outlet 26 of sand separator vessel 22. At production outlet 26 clean fluid may exit sand separator vessel 22 and continue to choke manifold skid 30 by production lines 28. A choke manifold may be controlled to allow the flow of the clean fluid to the production facility for further processing.

Furthermore, sand separator vessel 22 also comprises discharge outlet 34 configured to discharge the sand and any other materials that have been separated from the mixture by sand separator vessel 22. As stated above, the sand must be periodically removed from sand separator vessel 22. To move the sand from sand separator vessel 22, discharge outlet 34 may be opened providing well fluid under pressure from wellhead 12 forcing the sand from the lower accumulator section of sand separator vessel 22 into discharge line 36. Discharge outlet 34 may be coupled to discharge line 36, and discharge line 36 may be configured to move discharge fluid comprising the sand and the well fluid mixture from sand separator vessel 22 to storage container 58, which, in some embodiments, is an open top tank.

After exiting sand separator vessel 22, the discharge fluid may enter discharge line 36. At mini dump skid 40, which is optional in some embodiments, various valves 52 may be disposed in discharge line 36 to control flow of the discharge fluid from sand separator vessel 22. As shown, mini dump skid 40 comprises a shutoff valve (SOV) and an on/off control valve (XV) configured to control the flow between various flow lines. When mini dump skid valves are open and other valves 52 downstream of mini dump skid 40 are open (e.g., control valve 54 discussed in detail below), the sand may be moved by the pressure from the well through discharge line 36 to storage container 58.

After sand has been moved from mini dump skid 40 along discharge line 36, various sensors 14 and valves 52 may be disposed along discharge line 36. As described below, sensors 14 may comprise accelerometers, pressure transducers ("PIT"), temperature sensors ("TIT"), density meters ("DM"), liquid level meters ("LT"), flow rate meters, and the like. In some embodiments, sensors 14 may be provided at each section of discharge line 36 between each valve of valves 52. As such, the state of flow at each point along discharge line 36 can be known.

For the discharge fluid to flow to storage container 58, all valves 52 must be at least partially open. As illustrated, dump skid comprises a shutoff valve ("SOV"), on/off control valve ("XV"), and choke valve ("CV") referenced herein as discharge control valve 54); however, any other valves may be provided if needed. In some embodiments, all valves 52 may be fully open except discharge control valve 54. Discharge control valve 54 may be specifically operated to control the flow of discharge fluid based on the sensor data and calculations described in detail below. However, controlling discharge control valve 54 is exemplary, and it should be understood that any, all, and any combination of valves 52 shown in FIG. 1 and described herein may be controlled to control the flow of discharge fluid throughout discharge line 36.

Furthermore, in some embodiments, fixed choke 56 may be an optional component that may be used similarly to discharge control valve 54. For example, PIT may be positioned upstream and downstream of fixed choke 56 to measure differential pressure as described in detail below.

In some embodiments, sensor data may be received and processed by control system 50. Furthermore, control system 50 may generate and transmit signals controlling actuator 80 (FIG. 3) to actuate discharge control valve 54. Though control system 50 is described in detail below and illustrated in FIG. 4, a brief description is provided here. Control system 50 may comprise one or more non-transitory computer-readable media storing computer-executable instructions to perform the methods described herein. The methods include obtaining data from sensors 14, calculating various parameters related to sand flow characteristics, determining instructions to optimally actuate control valve 54, and transmitting the signal to actuator 80 to actuate control valve 54. Furthermore, updated position settings and duration settings of discharge control valve 54 as well as cycle initiation times may be stored for controlling discharge control valve 54 on future evacuation cycles.

Furthermore, control system 50 may provide a graphical user interface to an operator by a computing device such that the operator may operate system 10. Dump skid 48 may also comprise various emergency shutdown valves and devices (ESD, WESD) configured to isolate the separator vessel 22 from storage container 58 when emergency conditions occur during operation. Furthermore, in some embodiments, control system 50 comprises mobile device 60. Mobile device 60 may provide various applications operable by the operator of system 10. Mobile device 60 may be configured to control system 10 by various communication protocols described below. Control system 50 is described in more detail below and illustrated in FIG. 4.

Figure 3:
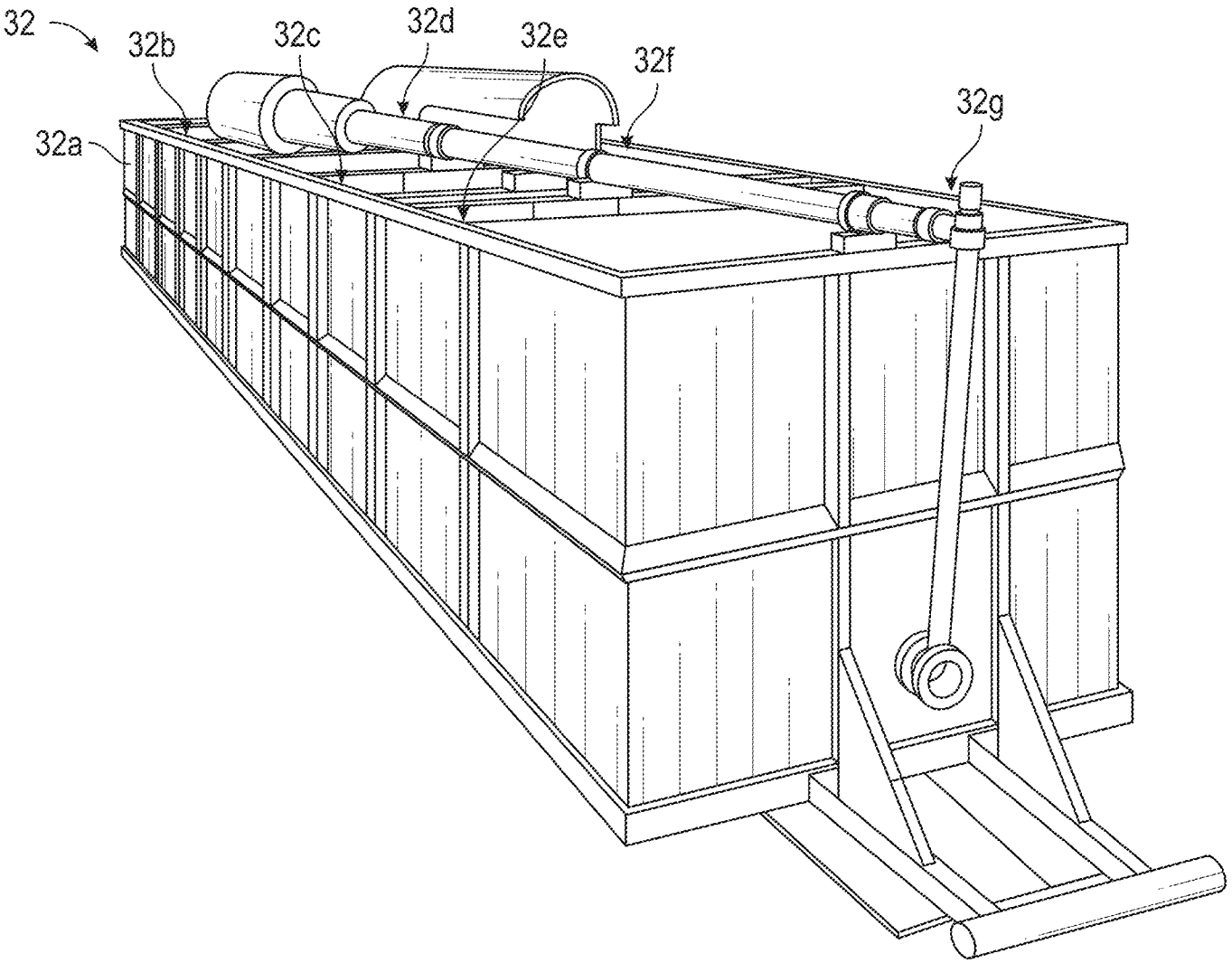
FIG. 3 depicts an exemplary storage container and gas sensor positions.

Storage container 58 may be provided at an end of discharge line 36 for receiving the discharge fluid (including the sand) therein. Storage container 58 may be any typical storage container in the industry, for example, an open top tank. In some embodiments, storage container 58 may include any sensors 14 including gas detection sensors 32 (FIG. 3). Sensors 14 at storage container 58 may provide additional information that may be used to control control valve 54, detect when the sand discharge is complete, and to detect when sand discharge has changed to a gas discharge phase. Furthermore, gas discharge may be quantified based on data from sensors 14, and fluid discharge may further be controlled based on a quantity, a time, and a duration of gas discharge. Any parameters described herein may be detected at storage container 58. Furthermore, storage container 58 is depicted in FIG. 3 and described in more detail below.

In some embodiments, continuing with system 10 in FIG. 1, power station 64 may provide power to system 10. Power station 64 may receive power from any local power grid and/or may generate power by fuel-powered generators 66 and/or solar panels and converters 62. The power may be stored in batteries on site such that constant power may be provided to control system 50, actuator 80, sand separator vessel 22 and any other power requirements for operation of system 10.

FIG. 2 depicts an exemplary embodiment of sand separator vessel 22 comprising a plurality of sand separating vessels 22*a*, 22*b*, 22*c*. Here, each sand separator vessel 22*a*, 22*b*, 22*c* may separate sand from different wellheads. Each sand separator vessel 22*a*, 22*b*, 22*c* may operate the same or similarly to sand separator vessel 22 as described above. As such, an amount of sand may be stored in each sand separator vessel 22*a*, 22*b*, 22*c* and the amount of sand stored in each may be different. As such, sensors 14 may be provided in each sand separator vessel 22*a*, 22*b*, 22*c* to determine an amount of sand in each. Furthermore, each line from each wellhead of the plurality of wellheads may comprise the various valves 52 and sensors 14 between wellhead 12 and sand separator vessel 22 described above.

Each discharge line 36*a*, 36*b*, 36*c* of plurality of discharge lines may be coupled to a mini dump skid 40*a*, 40*b*, 40*c* of a plurality of mini dump skids. Each mini dump skid 40*a*, 40*b*, 40*c* may comprise a plurality of valves 52 and a plurality of sensors 14 as described in reference to mini dump skid 40 above. Each mini dump skid 40*a*, 40*b*, 40*c* may also comprise couplers coupling each discharge line 36*a*, 36*b*, 36*c* to discharge line 36 to dump sand from each sand separator vessel 22*a*, 22*b*, 22*c* into storage container 58 by way of dump skid 40. In some embodiments, sensors 14 may be disposed on each discharge line 36*a*, 36*b*, 36*c* coupled to each sand separator vessel 22*a*, 22*b*, 22*c* and/or at each mini dump skid 40*a*, 40*b*, 40*c*. Utilizing data from the sensors 14, the amount of sand in each sand separator vessel 22*a*, 22*b*, 22*c* and an amount of sand flowing from each sand separator vessel 22*a*, 22*b*, 22*c* may be determined. Control of discharge control valve 54 may be determined based on the amount of sand in and the volume flow to and from each sand separator vessel 22*a*, 22*b*, 22*c*.

FIG. 3 depicts an exemplary embodiment of storage container 58 comprising gas detection sensors 32. As described above, if the evacuation cycle goes too long, or discharge control valve 54 is open too much, gas can be expelled into the atmosphere through storage container 58. However, the end of the sand discharge cycle also represents the beginning of the gas discharge cycle. Therefore, it is desirable to eliminate all sand and stop the discharge cycle ideally before any gas is expelled. However, in reality, the objective may be to maximize sand discharge and minimize gas discharge.

Various gas detection sensors 32 may be provided at storage container 58 for detecting the gases that are expelled from discharge line 36 and released by materials stored in storage container 58, which is referred to herein as "discharge gas." Here, gas detection sensors 32 are depicted at various case detection sensor locations 32*a*-32*g*. Gas detection sensor locations 32*a*-32*g* are exemplary, and gas detection sensors 32 may be provided at any point in and on discharge line 36 and in, on, and around storage container 58. In some embodiments, gas detection sensors 32 may comprise optical sensors, calorimetric sensors, acoustic-based sensors, electrochemical sensors, metal oxide-based sensors, capacitance-based sensor and any other sensor that can detect gases. Furthermore, gas detection sensors 32 may comprise any other sensors 14 described herein. Gas detection sensors 32 may be configured to detect methane, ethane, propane, butane, benzene, toluene, xylene, hydrogen sulfide, carbon monoxide, oxygen, and any other gases that may be useful in quantifying the discharge gas. Gas detection sensors 32 may be configured to detect any gas in the vicinity of storage container 58 and may be positioned at strategic locations in and on storage container 58 including in discharge line 36 and at outlets to discharge line 36.

Figure 5:
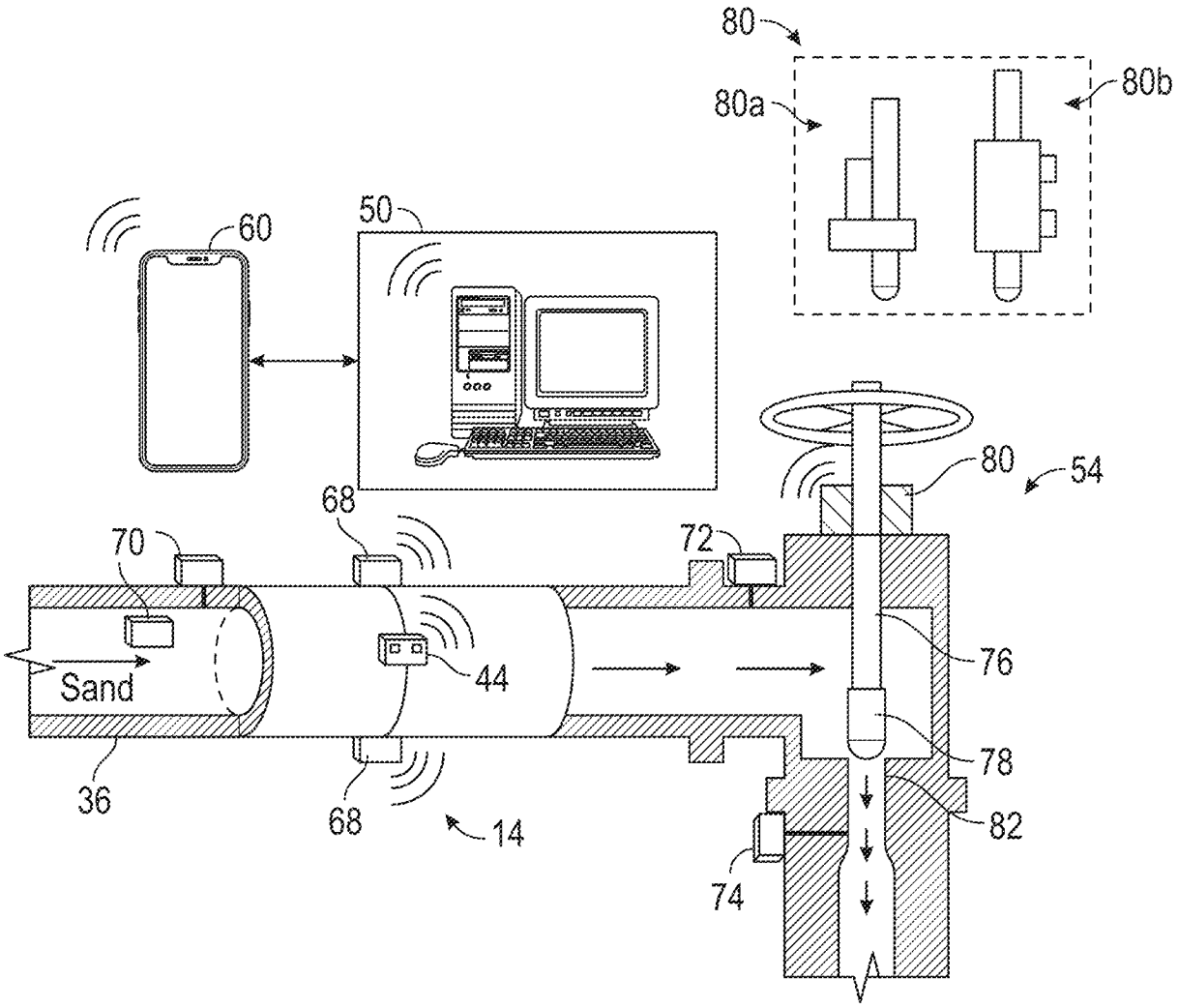
FIG. 5 depicts an exemplary embodiment of a control system and a discharge line comprising a discharge control valve.

The sensor data obtained from sensors 14, particularly gas detection sensors 32, may be consistent across evacuation processes. For example, the discharge gas may be detected by gas detection sensors 32. The gas data can be obtained from the gas detection sensors 32 and processed by control system 50 (FIG. 5). From the gas data, an identifiable spike in the quantity of discharge gas can be detected. In some embodiments, a gas discharge profile is generated based on a history of discharge cycles. The gas discharge profile may be identifiable, consistent, and unique to any particular well. The gas discharge profile may be indicative of a time of gas discharge, a duration of gas discharge, a quantity of gas discharge, a type of gas discharge, and the like. Furthermore, in some embodiments, the gas discharge profile may be based on sensor data from sensors 14 positioned throughout system 10 including gas detections sensors 32. As such, the transition from the fluid discharge phase to the gas discharge phase may be predictable based on the sand/fluid quantification, discharge line flow characteristics, gas discharge measurements, and the gas discharge profile (based on the gas discharge history of various wells and previous discharge cycles).

Gas composition and concentration of various gas components may be detected at various locations in discharge line 36 and in and around storage container 58. The gas compositions and gas component concentrations may be processed to calculate total compositions and total quantities of the various detected gases described above. As such, an amount of gas discharged from discharge line 36 can be determined over time intervals (e.g., portions of an evacuation cycle, a total evacuation cycle, or a plurality of evacuation cycles). The sand quantity, timing, and duration of the sand discharge may be combined with gas quantity, timing, and duration of the gas discharge to calculate optimal cycle times and open amount and duration of discharge control valve 56 as described below.

Figure 4:
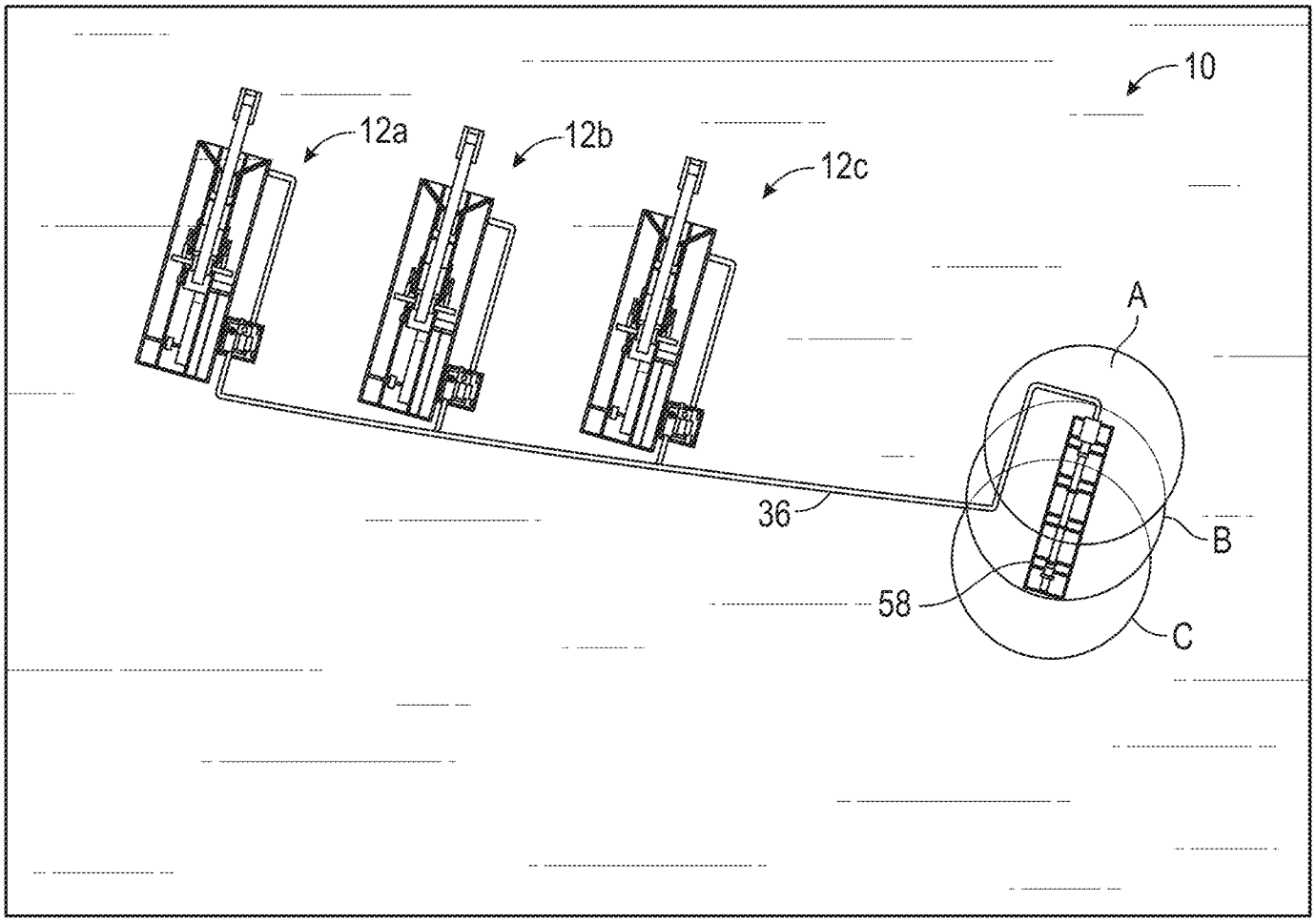
FIG. 4 depicts an exemplary ariel view of an oil and gas well system.

FIG. 4 depicts an exemplary arial view of well system 10 illustrating a relative zone of detecting gas expelled from storage container 58. As shown, wells 12*a*, 12*b*, 12*c*, are provided along with discharge line 36. Discharge line 36 connects wells 12*a*, 12*b*, and 12*c* with storage container 58 as illustrated in FIG. 1. In some embodiments, storage container 58 is positioned a minimum distance from wells 12 such that any gas discharged at storage container 58 dissipates into the atmosphere at or before a minimum distance from wells 12*a*, 12*b*, and 12*c*.

As described above, gas detection sensors 32, can be configured to detect gas expelled from discharge line 36 and the contents of storage container 58. Zones A, B, and C depict exemplary areas where gas can be detected. Zones A, B, and C are exemplary of a detection area in and around storage container 58 where gas can be detected. The detection area is based on gas detection sensors 32 and locations of gas detection sensors 32. As shown in FIGS. 3 and 4, gas detection sensors 32 are provided at storage container 58; however, it can be imagined that gas detections sensors 32 may be positioned anywhere in well system 10. As such, zones A, B, and C depicted in FIG. 4 are exemplary. Any number of zones may be provided at any locations at and around well system 10.

FIG. 5 depicts system 10 illustrating a closeup and cross-section view of discharge line 36 comprising discharge control valve 54. As shown, discharge fluid flows through discharge line 36 from the left as sand separator vessel 22 is provided upstream. As the discharge fluid moves through discharge line 36, sensors 14 detect various parameters that can be used to determine control instructions for discharge control valve 54. For example, sensors 14 may comprise internal sensors 70 internal to discharge line 36 and exterior sensors 68 external to discharge line 36. As illustrated in FIGS. 1 and 3, sensors 14 may comprise piping fluid pressure transducers (PIT), piping fluid temperature sensors (TIT), piping fluid bulk density meter (DM), piping fluid flow rate meter (not shown), liquid level sensor (LT), as well as any other sensors that may provide data usable for determining volume flow and sand weight. Here, pressure transducers 72, 74 may be provided upstream and downstream of choke valve (CV) referenced herein as discharge control valve 54. The pressure transducers 72, 74 may be configured to detect the pressure differential across discharge control valve 54. The pressure differential may be used to calculate discharge volume and discharge sand weight and is described in detail below. Furthermore, the pressure differential may be measured across fixed choke 56. PIT may be positioned upstream and downstream of fixed choke 56 to measure differential pressure. The differential pressure used in calculations described herein may be calculated across fixed choke 56.

In some embodiments, discharge control valve 54 is configured to actuate stem 76, which extends and retracts choke tip 78. Discharge control valve 54 may comprise choke seat 82 configured to receive choke tip 78. In some embodiments, choke tip 78 and/or choke seat 82 may comprise rubber, plastic, metal, or any other material that may create a seal between the upstream flow and downstream flow by interacting with choke tip 78. As actuator 80 (e.g., linear actuator 80*a* or rotary actuator 80*b*) is actuated to close discharge control valve 54, choke tip 78 may be pressed into choke seat 82 to seal discharge line 36 and prevent the flow of discharge fluid. Similarly, or alternatively, actuator 80 may be actuated to open by raising choke tip 78 out of choke seat 82 to open discharge control valve 54 and allow discharge fluid to flow through discharge line 36. As described herein, in some embodiments, choke tip 78 may only slightly be removed from choke seat 82 to provide a relatively small opening for discharge fluid to flow. Even though the opening is small, as the pressure may be up to 10,000 psi and above, a large amount of discharge fluid may pass to storage container 58 in a small amount of time. As such, the position settings and the duration settings for discharge control valve 54 for each evacuation cycle may only slightly change but may have a dramatic effect on the amount of sand and gas that is discharged.

Furthermore, in some embodiments, sensors 14 comprise piping fluid temperature sensors (TIT). Here, temperature sensors may be clamped onto the exterior of discharge line 36 represented by exterior sensors 68 or internal to discharge line 36 represented by internal sensors 70. Furthermore, sensors 14 may comprise piping fluid bulk density meter (DM, i.e., density meter 44) and piping fluid flowrate meter (not shown). Furthermore, sensors 14 may comprise flow meters disposed internal to discharge line 36 represented by internal sensors 70 at various points upstream and downstream of each choke valve. In some embodiments, flowrates may be calculated from differential pressures provided by the pressure transducers and/or liquid level instrument detecting fluid levels in storage container 58. Sensors 14 described herein are exemplary and nonlimiting. Any sensors 14 that may be used in collecting and calculating sand and discharge fluid flow parameters may be incorporated into system 10. Furthermore, the illustrated placement of sensors 14 in FIGS. 1 and 3 are exemplary. Sensors 14 may be placed at any location in system 10 to obtain data indicative of discharge sand amount, discharge volume, gas discharge amount, and discharge fluid flowrates.

Internal sensors 70 may comprise any flow meter, pressure transducer, or temperature sensor described above. In some embodiments, internal sensors 70 may be fixed to an inner wall of discharge line 36 or suspended at, or near, a center of discharge line 36 depending on an optimal location to detect flow parameters. For example, a flow meter may be provided in discharge line 36 to measure the flowrate at low pressures. The internal instant flowrate may be provided as an input to an algorithm to determine an average sand/volume flowrate through discharge line 36 based on other parameters such as, for example, temperature, pressure, and the like. However, as described above, as the discharge fluid flows through discharge line 36 at extremely high speeds and pressures (e.g., up to 10,000 psi), it may be difficult to maintain sensors on the interior of discharge line 36. As such, methods of determining flowrate utilizing sensors on the exterior of discharge line 36 may not only be beneficial but may be necessary in embodiments of the current disclosure as internal sensors 70 may not be possible. Here, the exemplary pressure of 10,000 psi is described; however, it should be understood that any pressure above and below 10,000 psi could be provided in system 10. The fluid control processes, and system described herein are not limited to any particular well pressure.

Furthermore, in some embodiments, internal sensors 70 may comprise pressure transducers. Pressure transducers may be provided at various locations such as in line with the flow in discharge line 36 and/or at angles to the flow discharge line 36. As such, static pressure and/or dynamic pressure may be detected, and total pressure may be calculated. Pressure transducers may be positioned at any location including at sand separator vessel 22, storage container 58, and any position along discharge line 36. In some embodiments, pressure transducers may be positioned between and/or at each choke valve of valves 52 and may further be positioned at locations of other sensors 14 to determine a state of the fluid at each specified location. As described in detail below, first pressure transducer 72 and second pressure transducer 74 may be positioned in either side (upstream and downstream) of discharge control valve 54. As such, the differential pressure across discharge control valve 54 may be calculated and used to determine discharge fluid flowrate, volume discharge, and discharge sand weight. Any detected and calculated pressure may be used to determine weight of sand, discharge volume, discharge fluid flowrate at any location including sand separator vessel 22, storage container 58, and at any location along discharge line 36.

In some embodiments, sensors 14 can be disposed on the exterior of discharge line 36 represented by exterior sensors 68. Exterior sensors 68 may be the only sensors disposed on discharge line 36 or may be used in coordination with internal sensors 70; however, as mentioned above, internal sensors 70 may be difficult to maintain. As such, in some embodiments, only exterior sensors 68 are disposed on discharge line 36, and only data from exterior sensors 68 is used for calculations for quantifying sand discharge and controlling discharge control valve 54. For example, piping fluid bulk density meter (DM) referenced herein as density meter 44, may be disposed on the exterior of discharge line 36. Density meter 44 may be any density meter that may detect the density of the discharge fluid flowing through discharge line 36. Density meter 44 may be disposed between wellhead 12 and sand separator vessel 22, at sand separator vessel 22, between sand separator vessel 22 and storage container 58 at any point, or points, along discharge line 36, and at storage container 58. In some embodiments, a plurality of density meters 44 may be disposed at points listed above. Density meter 44, may detect a density of the fluid flowing through discharge line 36 by providing a vibration-based percussive technology that is non-radioactive and non-invasive to the discharge line 36. In some embodiments, density meter 44 may be any standard density meter that may detect the density of discharge fluid through discharge line 36.

In some embodiments, exterior sensors 68 may comprise accelerometers and temperature sensors. Accelerometers may be used to measure piping/valve vibration as the sand flows through discharge line 36. Accelerometers may be disposed at various strategic locations along discharge line 36. The vibration of discharge line 36 may be indicative of an amount sand and a rate of the discharge fluid flowing through discharge line 36. As the sand flows through discharge line 36 at a high rate and under pressure, the vibration of discharge line 36 may provide usable information in determining the discharge fluid flowrate, the discharge fluid phase, the discharge volume, and sand weight. Furthermore, the detected vibrations may be combined with density, pressure, and temperature information to calculate accurate flowrate and sand quantity discharge results. Furthermore, accelerometers, temperature sensors, pressure transducers, density meters, and any other sensors 14 may be provided at the same or similar locations (e.g., before and after each choke valve). As such, flowrates can be calculated at various locations along discharge line 36 to quantify the amount of sand flowing through discharge line 36 at any point.

In some embodiments, temperature sensors may be provided at the interior and/or the exterior of discharge line as represented by internal sensors 70 and exterior sensors 68. As such, a temperature of the discharge fluid flowing through discharge line 36 may be detected and/or calculated. In some embodiments, a direct temperature of the discharge fluid may be calculated by a temperature sensor disposed internal to discharge line 36. In some embodiments, a temperature sensor may be disposed on an external side of discharge line 36 and the internal temperature may be estimated using an external air temperature and a temperature of the discharge line 36 measure over time. Temperature of the fluid inside discharge line 36 may be combined with pressures, density measurements, and the like, to determine flowrate, sand quantity, and discharge volume through discharge line 36.

In some embodiments, the discharge volume can be calculated using Eq. 1 and the weight of sand being discharged to storage container 58 can be calculated using Eq. 2 below. The values may be calculated at any point during the evacuation cycle with the initial time being the time that discharge fluid began flowing (i.e., when discharge control valve 54 was opened).

$$V_d = \int_{T_1}^{T_n} Q(T)dT \quad \text{Eq. 1}$$

$$\sum_{T_1}^{T_n} S_d \quad \text{Eq. 2}$$

Here, volume discharge $V_d$ may be calculated as the flowrate of the discharge fluid Q(T) comprising the sand through control valve 54 during the time that control valve 54 is open. As described above flowrate may be determined based at least in part on the differential pressure across control valve 54. The data from sensors 14 (i.e., first pressure transducer 72 and second pressure transducer 74) may be used to calculate the flow rate as unit volume of fluid per unit time. As measured by the density meter 44, the instantaneous density is known for the given volume. As such discharge fluid flowrate can be calculated utilizing the pressure differential, density, and various constants related to the sensors and piping geometry. Utilizing this information, the discharge volume can be calculated by integrating the flowrate over the time. Here, the time may represent a full evacuation cycle. In some embodiments, the time may represent a portion of an evacuation cycle.

Furthermore, the weight of the sand that has been discharged up to the current time sample can be calculated. Assuming a base fluid for the discharge fluid comprises a density at or near that of water, the density of water can be used to subtract from the measured density of the discharge fluid density to determine a sand density in mass per unit volume. Then multiplying the density of the sand by the calculated discharge volume provides the mass of the sand, or weight of the sand. Furthermore, if portions of the total evacuation cycle are determined, the total weight of sand discharge can be calculated by summing each sand weight at each calculated time interval for the duration of the control valve opening. As such, the total weight of sand disposed into the storage container 58 at any time including the entire duration of the evacuation cycle can be estimated. Furthermore, if a starting quantity of sand held in the lower accumulator section of sand separator vessel 22 is known, it is also known how much sand is left to be moved at any time interval.

In some embodiments, the time that control valve is opened may be anywhere from 1-2 seconds to up to 10 seconds (for example) based on the total amount of sand to be moved and minimizing gas discharge. Based on the discharge volume of the discharge fluid and the density profile of the fluid, the amount of discharge sand in pounds can be calculated. As such, the state of discharge fluid and sand at the end of the evacuation cycle can be calculated. Additionally, in some embodiments, the quantity of sand discharged into the storage container 58 can be estimated at any point in the evacuation cycle. Furthermore, the quantity of gas discharge can be calculated from the gas data obtained from gas detection sensors 32. Comparing the gas data obtained during the evacuation cycle with the gas profile associated with the current well being evacuated, an optimal shutoff time (or close time) for discharge control valve 54 can be determined. As described above, gas discharge profile includes a known spike in gas discharge from discharge line 36 just after sand evacuation is complete. Combining gas data and fluid parameters detected by sensors 14 and the quantities flowrates calculated above a moment that the discharge fluid changes from sand discharge to gas discharge can be estimated. Slightly before, slightly after, at the estimated point of the sand-to-gas transition, discharge control valve 54 can be closed. The exact moment that discharge control valve 54 is actuated may be based on maximizing the sand quantity discharge while minimizing the gas discharge and accounting for acceptable limits of sand quantity not discharged and gas discharge amounts. Knowing the state of the system at all times allows optimal control of the discharge control valve 54 at any time during the evacuation cycle.

Furthermore, the calculated discharge volume and sand weight can be determined from sensor data obtained by the density meter 44 and the first pressure transducer 72 and the second pressure transducer 74 only. Though other sensors may provide additional data, the sand weight, discharge fluid flowrate, and the discharge volume may be determined using only data from pressure transducers 72, 74 and density meter 44.

In some embodiments, discharge control valve 54 may be controlled to open to position settings, duration settings, and at cycle initiation times based at least in part on the sand weight, discharge volume, gas discharge, and/or discharge fluid flowrate. Based at least in part on the above-described calculations, discharge control valve 54 may be controlled by control system 50. In some embodiments, control system 50 comprises linear, nonlinear, and/or adaptive control algorithms for controlling discharge control valve 54 by actuator 80. In some embodiments, an artificial intelligence algorithm such as, for example, a neural network may be trained to determine an optimal volume flow and flow time to discharge the sand and an optimal opening and open duration of discharge control valve 54 to discharge the sand over the course of an evacuation cycle. In some embodiments, the controller is based at least in part on receiving the sand weight, the discharge volume, discharge fluid flowrate, gas discharge quantity, gas discharge flowrate, and/or data from sensors 14. Furthermore, control system 50 may output signals (e.g., PWM) configured to control the actuator 80 based on the controller output to actuate discharge control valve 54. Control system 50 may be configured to control the discharge control valve 54 to maximize sand discharge and minimize a gas discharge by controlling the open amount to the predetermined open settings and the open duration to the predetermined open duration at the predetermined cycle initiation time. As such, the time that discharge line 36 is open to the atmosphere is minimized reducing an amount of gas discharge (e.g., methane and VOC) released into the atmosphere over typical methods. Therefore, each evacuation cycle is more efficient than current methods creating an accumulative effect on efficiency and environmental impact.

In some embodiments, indication that the evacuation cycle is complete may be based on a state change of discharge fluid in discharge line 36. As described above, the open duration of discharge control valve 54 may be determine from previous evacuation cycles. However, in some embodiments, discharge control valve 54 may be controlled to close during an evacuation cycle based on the instrumentation measurements. The state of the discharge fluid flowing through discharge line 36 may change from a denser fluid containing a large, calculated quantity of sand to a fluid state containing a small to no quantity of sand and a more gaseous fluid state. At this point and based on the detection of the more gaseous state of the discharge fluid and the gas profile describe above, discharge control valve 54 may be actuated to close, stopping the flow through discharge line 36. As such, the sand from sand separator vessel 22 has been deposited into storage container 58 and immediately halting the flow based on the detection of the discharge fluid state prevents the gas from being expelled into the storage container 58 and into the atmosphere.

Furthermore, in some embodiments, evacuation cycle initiation times may also be calculated. As described above, evacuation cycles may be determined by previous cycle times and the weight of sand evacuated during those time. A time between cycles, referenced herein as cycle initiation times, can also be adjusted to optimize evacuation. For example, if too many cycles are occurring and, for each cycle, too much gas is released and too little sand is evacuated, the time between cycles can be increased to allow more sand to accumulate in sand separator vessel 22. In this case, the duration and/or the position of discharge control valve 54 may be increased to allow more sand to evacuate. Again, each evacuation cycle provides results that are included in updating the settings for each next evacuation thus, improving the results each time providing an accumulative effect on the efficiency and the environmental impact.

Figure 6:
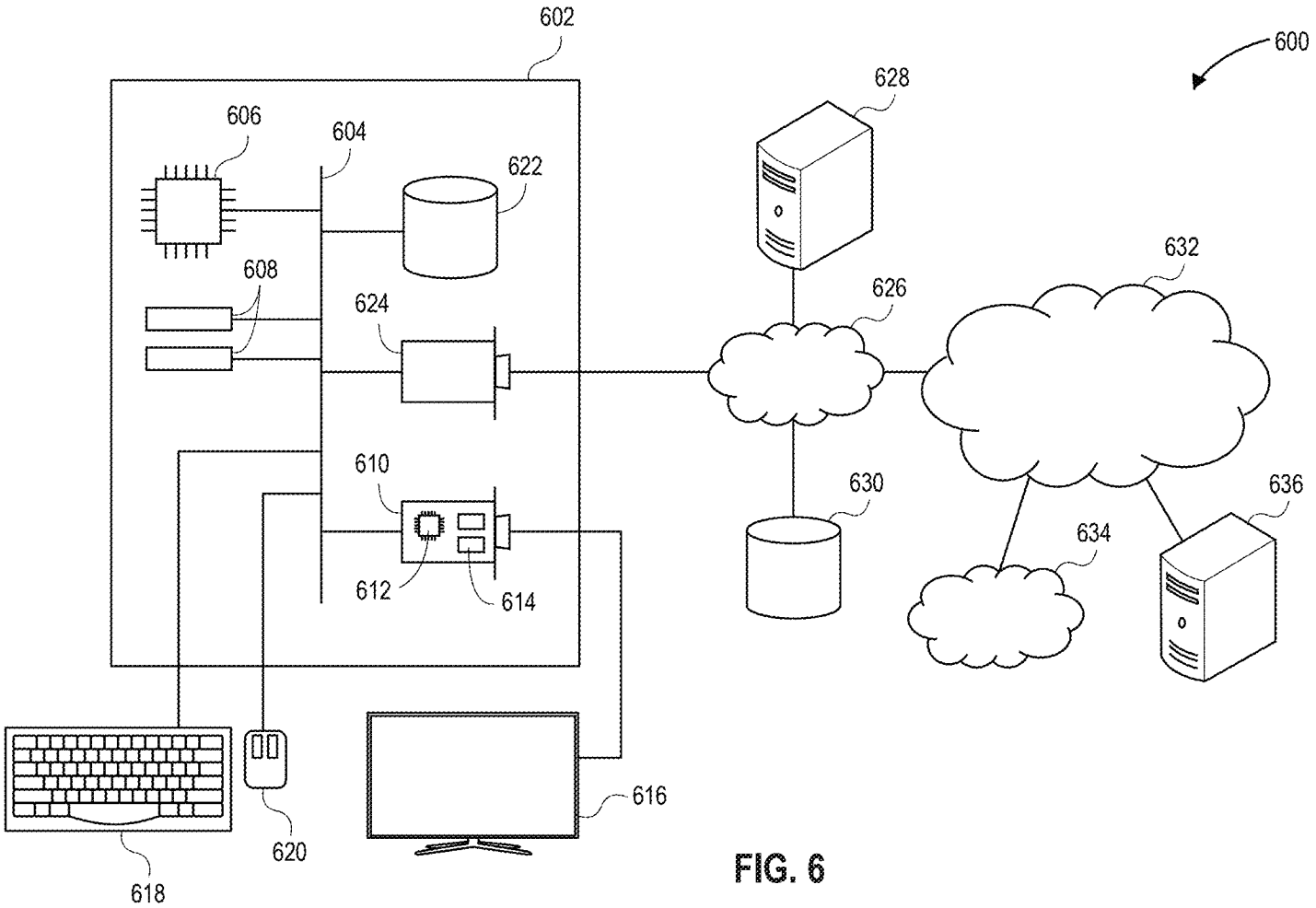
FIG. 6 depicts an exemplary hardware platform configured to control the evacuation system.

FIG. 6 illustrates one example of a hardware platform representative of an embodiment of hardware system 600. In some embodiments, control system 50 described above comprises the hardware system 600. Computer 602 can be any form factor of general- or special-purpose computing device. Depicted with computer 602 are several components for illustrative purposes. In some embodiments, certain components may be arranged differently or absent. Additional components may also be present. Included in computer 602 is system bus 604, whereby other components of computer 602 can communicate with each other. In certain embodiments, there may be multiple buses or components may communicate with each other directly. Connected to system bus 604 is central processing unit (CPU) 606. Also attached to system bus 604 are one or more random-access memory (RAM) modules 608. Also attached to system bus 604 is graphics card 610. In some embodiments, graphics card 610 may not be a physically separate card but rather may be integrated into the motherboard or the CPU 606. In some embodiments, graphics card 610 has a separate graphics processing unit (GPU) 612, which can be used for graphics processing or for general-purpose computing (GPGPU). Also on graphics card 610 is GPU memory 614. Connected (directly or indirectly) to graphics card 610 is display 616 for user interaction. In some embodiments, no display is present, while in others, it is integrated into computer 602. Similarly, peripherals such as keyboard 618 and mouse 620 are connected to system bus 604. Like display 616, these peripherals may be integrated into computer 602 or absent and may be provided as inputs by display 616. Also connected to system bus 604 is local storage 622, which may be any form of computer-readable media and may be internally installed in computer 602 or externally and removably attached.

Computer-readable media include both volatile and nonvolatile media, removable and nonremovable media, and contemplate media readable by a database. For example, computer-readable media include (but are not limited to) RAM, ROM, EEPROM, flash memory or other memory technology, CD-ROM, digital versatile discs (DVD), holographic media or other optical disc storage, magnetic cassettes, magnetic tape, magnetic disk storage, and other magnetic storage devices. These technologies can store non-transitory data temporarily or permanently. However, unless explicitly specified otherwise, the term "computer-readable media" should not be construed to include physical, but transitory, forms of signal transmission such as radio broadcasts, electrical signals through a wire, or light pulses through a fiber-optic cable. Examples of stored information include computer-useable instructions, data structures, program modules, and other data representations. In particular, computer-readable media includes non-transitory computer-readable media storing computer-executable instructions that, when executed, cause one or more processors to carry out operations.

Finally, network interface card (NIC) 624 is also attached to system bus 604 and allows computer 602 to communicate over a network such as local network 626. NIC 624 can be any form of network interface known in the art, such as Ethernet, ATM, fiber, Bluetooth, or Wi-Fi (i.e., the IEEE 802.11 family of standards). NIC 624 connects computer 602 to local network 626, which may also include one or more other computers, such as computer 628, and network storage, such as data store 630. Generally, a data store such as data store 630 may be any repository from which information can be stored and retrieved as needed. Examples of data stores include relational or object-oriented databases, spreadsheets, file systems, flat files, directory services such as LDAP and Active Directory, or email storage systems. A data store may be accessible via a complex API (such as, for example, Structured Query Language), a simple API providing only read, write, and seek operations, or any level of complexity in between. Some data stores may additionally provide management functions for data sets stored therein, such as backup or versioning. Data stores can be local to a single computer, such as computer 628, accessible on a local network, such as local network 626, or remotely accessible over Internet 632. Local network 626 is, in turn, connected to Internet 632, which connects many networks such as local network 626, remote network 634, or directly attached computers such as computer 636. In some embodiments, computer 602 can itself be directly connected to Internet 632.

Computer 602 described above my represent controller system 50. Furthermore, computer 602 may be connected to mobile device 60. Mobile device 60 may be computer 602 or may be computer 628 connected to computer 602 over local area network 626 or may be computer 636 connected over the Internet 632. Furthermore, mobile device 60 may be configured to run an application associated with system 10 and operable to control various aspects of system 10.

Figure 7:
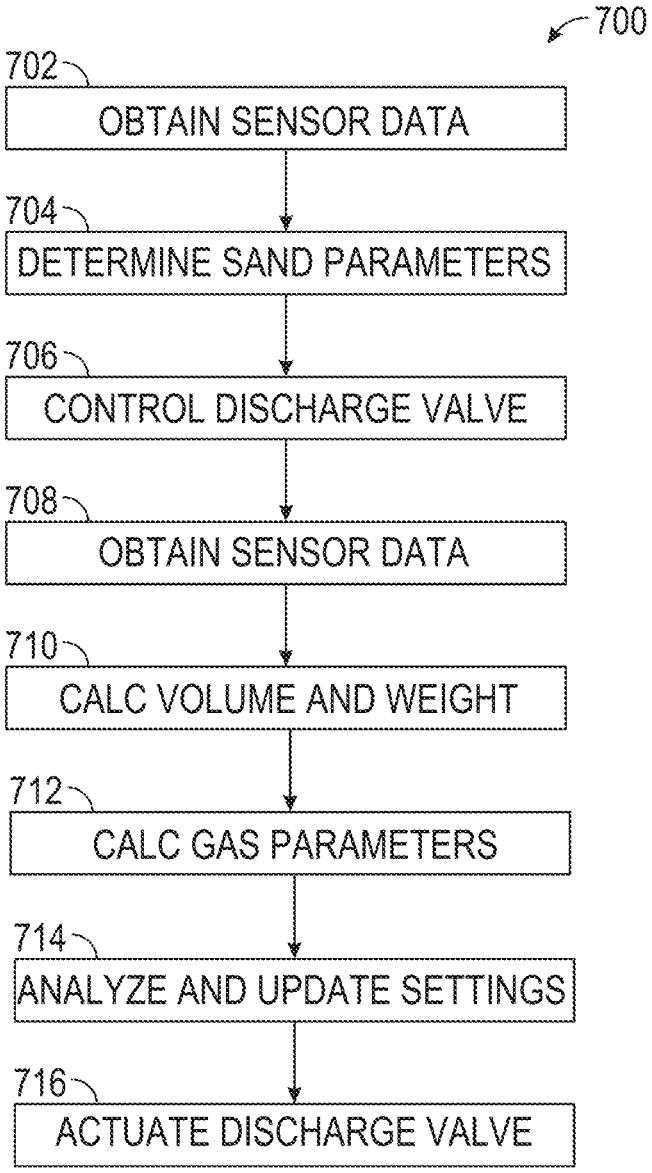
FIG. 7 depicts a flow chart illustrating a method of quantifying discharged sand and discharge gas and controlling a fluid evacuation cycle.

FIG. 7 depicts an exemplary method of controlling sand discharge from sand separator vessel 22 to storage container 58 generally referenced by the numeral 700. At step 702, preliminary data indicative of an amount of sand in sand separator vessel 22 is obtained from sensors 14. In some embodiments, the preliminary data may comprise data indicative of sand flowing into sand separator vessel 22.

Here, the preliminary data may be data obtained from sensors 14 disposed between wellhead 12 and sand separator vessel 22. As such, an amount of sand deposited into sand separator vessel 22 may be calculated at step 704. Furthermore, in some embodiments, sensors 14 may be disposed at sand separator vessel 22 detecting weight and height of sand in the lower accumulator section of sand separator vessel 22. As such, an amount of sand in sand separator vessel 22 may be estimated again at step 704.

In some embodiments, at step 704 a time from a last evacuation cycle is complete and a time to initiate the next cycle begins. The time between cycles may be representative of the sand accumulation in sand separator vessel 22. As such, it may be estimated that sand separator vessel 22 is full and the sand may be evacuated by opening control valve 54.

At step 706, discharge control valve 54 is actuated open, and the fluid begins to flow through discharge line 36. Here, discharge control valve 54 may be opened to an initial position based on expected flow from a previous cycle, an initial cycle, an amount of sand in sand separator vessel 22, the well pressure, the gas profile, and the like. Here, the well pressure forces the sand and fluid from the well through discharge line 36 evacuating the sand from sand separator vessel 22 as described above. The discharge fluid including the sand may be moved from sand separator vessel 22 through discharge line 36 to storage container 58.

At step 708, at least pressure data and density data are obtained from sensors 14 to quantify sand discharge. As described above, density meter 44 may be disposed at any point or points along discharge line 36. Density meter 44 may detect the density of the discharge fluid flowing through discharge line 36 using the above-described vibration-based percussive density meter that is non-radioactive and non-invasive to the discharge line 36. As such, a density of the discharge fluid may be determined. Furthermore, pressure transducers may be disposed at specific locations along discharge line 36. The pressure transducers may detect the pressure inside discharge line 36. Furthermore, the pressure at distinct locations may be detected. For example, first pressure transducer 72 may be disposed on an upstream side of discharge control valve 54 and second pressure transducer 74 may be disposed on the downstream side of discharge control valve 54. By calculating the pressure differential across discharge control valve 54 and utilizing the measure discharge fluid density, and other known and assumed constant factors, various flow parameters may be calculated.

Furthermore, the sensor data from sensors 14 may comprise data from gas detection sensors 32. As described above, gas detection sensors 32 may comprise optical sensors, calorimetric sensors, acoustic-based sensors, electrochemical sensors, metal oxide-based sensors, capacitance-based sensor and any other sensor that can detect gases. Furthermore, gas detection sensors 32 may comprise any other sensors 14 described herein. Gas detection sensors 32 may be configured to detect methane, ethane, propane, butane, benzene, toluene, xylene, hydrogen sulfide, carbon monoxide, oxygen, and any other gases that may be useful in quantifying the discharged gas. Gas detection sensors 32 may be configured to detect any gas in the vicinity of storage container 58 and may be positioned at strategic locations in and on storage container 58 including in discharge line 36 and at outlets to discharge line 36.

At step 710, the pressure differential, the fluid density, and other known and assumed constant factors can be used to calculate discharge fluid flowrate. The discharge fluid flowrate may then be integrated over time to determine discharge volume of discharge fluid for the time period giving a unit discharge volume of the discharge fluid. Furthermore, sand weight may be determined. Assuming a base fluid for the discharge fluid comprises a density at or near that of water, the density of water can be used to subtract from the measured density of the discharge fluid density to determine a sand density in mass per unit volume. Then multiplying the density of the sand by the calculated discharge volume provides the mass of the discharged sand, or weight of the discharged sand. As such, the amount of sand that is moved from sand separator vessel 22 to storage container 58 over any time while discharge control valve 54 is open can be estimated.

Furthermore, at step 712, gas discharge quantity may be calculated. Gas data obtained from gas detection sensors 32 may be processed to estimate gas discharge quantity. Gas component composition and concentration of gas components may be detected at various locations in discharge line 36 and in and around storage container 58. The gas component compositions and concentrations may be processed to calculate total component compositions and total quantities of the various detected gases described above. As such, an amount of gas discharged from discharge line 36 can be determined over time intervals (e.g., portions of an evacuation cycle, a total evacuation cycle, or a plurality of evacuation cycles). The sand quantity, timing, and duration of the sand discharge may be combined with gas quantity, timing, and duration of the gas discharge to calculate optimal cycle times.

At step 714, the results of the previous cycle may be analyzed and new settings for the next evacuation cycle may be determined. Based on the results of the most recent evacuation cycle, it may be determined that the flow may be too fast, too slow, contain more or less sand than expected, expel more or less gas than expected, and the like. For example, if the most recent evacuation cycle resulted in more sand than was expected, the initial position of discharge control valve 54 may be opened more than previously. As such, more sand may be removed in a given time and/or the duration may be less. Furthermore, based on the results of the most recent evacuation cycle, it may be determined that the flow may be too fast, too slow, and expel more or less gas than desired, and the like. For example, if too much gas was discharged after the sand-to-gas transition, the next cycle may be shortened to evacuate all sand but close discharge control valve 54 before gas is discharged.

Furthermore, in some embodiments, real-time control of the discharge control valve 54 may be updated based on the results of previous evacuation cycles. Therefore, each evacuation cycle is more efficient than current methods creating an accumulative effect on efficiency and environmental impact. As such, knowing the sand quantity, the discharge fluid flow parameters, and the gas discharge allows optimized control of discharge control valve 54 to maximize the sand discharge while minimizing gas discharge in the next cycle. The position settings, duration settings, and the cycle initiation time of discharge control valve 54 may be adjusted based on the previous results.

At step 716, discharge control valve 54 may be opened after a determined time to initiate a new evacuation cycle. Discharge control valve 54 may open to position settings to provide a maximum sand evacuation flowrate and to minimize gas discharge. Furthermore, discharge control valve 54 may open for an optimal duration based on the previous cycle results to evacuate all sand from sand separator vessel 22 while minimizing gas discharge.

In some aspects, the techniques described herein relate to an automated sand evacuation system for automatically controlling flow of a discharge fluid in a discharge line of an oil and gas well system.

In some aspects, the automated sand evacuation system includes a plurality of interconnected pipes configured to move sand from a sand separating vessel to a storage container.

In some aspects, the techniques described herein relate to a plurality of valves including a discharge control valve configured to allow the discharge fluid including the sand to flow through the plurality of interconnected pipes to the storage container when open and prevent the discharge fluid from flowing when closed.

In some aspects, the techniques described herein relate to a plurality of sensors configured to detect parameters indicative of the discharge fluid in the discharge line.

In some aspects, the techniques described herein relate to one or more non-transitory computer-readable media storing computer-executable instructions that, when executed by at least one processor, perform a method of quantifying the sand in an evacuation cycle and controlling the flow of the discharge fluid.

In some aspects, the techniques described herein relate to the method including obtaining the parameters from the plurality of sensors.

In some aspects, the techniques described herein relate to determining a flowrate of the discharge fluid based on the parameters; determining a discharge volume of the discharge fluid based on the flowrate.

In some aspects, the techniques described herein relate to determining a discharge sand quantity discharged during the evacuation cycle based on the discharge volume.

In some aspects, the techniques described herein relate to adjusting a position setting and a time setting for the discharge control valve based at least in part on the discharge sand quantity.

In some aspects, the techniques described herein relate to controlling the discharge control valve based on the position setting and the time setting.

In some aspects, the techniques described herein relate to an automated sand evacuation system, further including: a density meter disposed on an exterior side of the discharge line and configured to detect a discharge fluid density, wherein the parameters include the discharge fluid density.

In some aspects, the techniques described herein relate to an automated sand evacuation system, wherein the density meter is a non-radioactive non-invasive vibration-based percussive density meter.

In some aspects, the techniques described herein relate to an automated sand evacuation system, further including: a first pressure transducer disposed on the discharge line upstream of the discharge control valve and configured to collect first pressure data; a second pressure transducer disposed on the discharge line downstream of the discharge control valve and configured to collect second pressure data, wherein the parameters further include the discharge fluid density, the first pressure data, and the second pressure data; and wherein the method further includes: calculating a pressure differential across the discharge control valve using the first pressure data and the second pressure data; and calculating the flowrate of the discharge fluid based on the pressure differential and the discharge fluid density.

In some aspects, the techniques described herein relate to an automated sand evacuation system, wherein the method further includes: determining the discharge sand quantity by subtracting a base fluid density from the discharge fluid density of the discharge fluid to determine a result; and multiplying the result by the discharge volume to determine a weight of the sand.

In some aspects, the techniques described herein relate to an automated sand evacuation system, wherein the method further includes controlling a cycle initiation time based on the discharge sand quantity.

In some aspects, the techniques described herein relate to an automated sand evacuation system, wherein the method further includes detecting a state change in the discharge fluid and controlling the discharge control valve to close based on the state change.

In some aspects, the techniques described herein relate to an automated sand evacuation system, wherein the method further includes: detecting a state change in the discharge fluid and a state change time that the state change occurred; and updating the position setting and the time setting of the discharge control valve based on the state change time.

In some aspects, the techniques described herein relate to a method of quantifying sand in an evacuation cycle and controlling flow of a discharge fluid in an oil and gas well system, the method including: obtaining, from a plurality of sensors, parameters indicative of the discharge fluid flowing in a discharge line, wherein the plurality of sensors includes: a first pressure transducer disposed upstream of a discharge control valve; and a second pressure transducer disposed downstream of the discharge control valve; determining a pressure differential between a first pressure measured by the first pressure transducer and a second pressure measured by the second pressure transducer; determining a flowrate of the discharge fluid based on the parameters and the pressure differential; determining a discharge volume of the discharge fluid based on the flowrate; determining a discharge sand quantity discharged during the evacuation cycle based on the discharge volume; adjusting a position setting and a time setting for the discharge control valve based at least in part on the discharge sand quantity; and controlling the discharge control valve based on the position setting and the time setting.

In some aspects, the techniques described herein relate to a method, wherein the plurality of sensors includes a density meter and the parameters include a density of the discharge fluid; and wherein the method further includes determining the flowrate of the discharge fluid further based on the density of the discharge fluid.

In some aspects, the techniques described herein relate to a method, wherein the density meter is a non-radioactive non-invasive vibration-based percussive density meter.

In some aspects, the techniques described herein relate to a method, wherein the discharge sand quantity is a weight of the sand discharged into a storage container.

In some aspects, the techniques described herein relate to a method, further including: determining a cycle initiation time for a next evacuation cycle; controlling the discharge control valve to the position setting to initiate the next evacuation cycle; and closing the discharge control valve based on the time setting.

In some aspects, the techniques described herein relate to a method. The method, wherein a system pressure capacity is up to 10,000 pounds per square inch.

In some aspects, the techniques described herein relate to an automated sand evacuation system for automatically controlling sand and gas discharge of an oil and gas well system, the automated sand evacuation system including: a plurality of interconnected pipes including a discharge line configured to move the sand from a sand separating vessel to a storage container; a plurality of valves including a discharge control valve configured to allow a discharge fluid including the sand to flow through the plurality of interconnected pipes to the storage container when open and prevent the discharge fluid from flowing when closed; a plurality of sensors configured to detect fluid parameters indicative of the discharge fluid; a plurality of gas detecting sensors disposed at the storage container and configured to detect gas parameters indicative of the gas discharge from the discharge line; and one or more non-transitory computer-readable media storing computer-executable instructions that, when executed by at least one processor, perform a method of controlling flow of the discharge fluid, the method including: obtaining the fluid parameters and the gas parameters from the plurality of sensors; determining a discharge sand quantity discharged from the discharge line into the storage container; determining a gas discharge quantity discharged from the discharge line; and controlling the discharge control valve based on the sand quantity and the gas discharge quantity.

In some aspects, the techniques described herein relate to an automated sand evacuation system, wherein the plurality of sensors includes: a first pressure transducer disposed upstream of the discharge control valve; and a second pressure transducer disposed downstream of the discharge control valve; wherein the method further includes: determining a pressure differential between a first pressure measured by the first pressure transducer and a second pressure measured by the second pressure transducer; determining the discharge sand quantity discharged during an evacuation cycle based at least in part on the pressure differential.

In some aspects, the techniques described herein relate to an automated sand evacuation system, wherein the method further includes: determining a flowrate of the discharge fluid based on the parameters and the pressure differential; determining a discharge volume of the discharge fluid based on the flowrate; and determining the discharge sand quantity based on the discharge volume.

In some aspects, the techniques described herein relate to an automated sand evacuation system, wherein the method further includes detecting a state change in the discharge fluid and controlling the discharge control valve to close based on the state change.

In some aspects, the techniques described herein relate to an automated sand evacuation system, further including: a density meter disposed on an exterior side of the discharge line and configured to detect a discharge fluid density, wherein the parameters include the discharge fluid density.

In some aspects, the techniques described herein relate to an automated sand evacuation system, wherein the density meter is a non-radioactive non-invasive vibration-based percussive density meter.

Although the invention has been described with reference to the embodiments illustrated in the attached drawing figures, it is noted that equivalents may be employed, and substitutions made herein without departing from the scope of the invention.

Having thus described various embodiments of the disclosure, what is claimed as new and desired to be protected by Letters Patent includes the following:

The invention claimed is:

1. An automated sand evacuation system for automatically controlling flow of a discharge fluid in a discharge line of an oil and gas well system, the automated sand evacuation system comprising:

a plurality of interconnected pipes configured to move sand from a sand separating vessel to a storage container;

a plurality of valves including a discharge control valve configured to allow the discharge fluid including the sand to flow through the plurality of interconnected pipes to the storage container when open and prevent the discharge fluid from flowing when closed;

a plurality of sensors configured to detect parameters indicative of the discharge fluid in the discharge line; and one or more non-transitory computer-readable media storing computer-executable instructions that, when executed by at least one processor, perform a method of quantifying the sand in an evacuation cycle and controlling the flow of the discharge fluid, the method comprising:

obtaining the parameters from the plurality of sensors;

determining a flowrate of the discharge fluid based on the parameters;

determining a discharge volume of the discharge fluid based on the flowrate;

determining a discharge sand quantity discharged during the evacuation cycle based on the discharge volume;

adjusting a position setting and a time setting for the discharge control valve using the discharge sand quantity; and opening or closing the discharge control valve using the position setting and the time setting to control the flow of the discharge fluid.

2. The automated sand evacuation system of claim 1, wherein the plurality of sensors comprises a density meter disposed on an exterior side of the discharge line, a production line, or a wellhead line, and configured to detect a discharge fluid density, wherein the parameters comprise the discharge fluid density.

3. The automated sand evacuation system of claim 2, wherein the density meter is a non-radioactive non-invasive vibration-based percussive density meter.

4. The automated sand evacuation system of claim 3, wherein the plurality of sensors comprises:

a first pressure transducer disposed on the discharge line upstream of the discharge control valve and configured to collect first pressure data;

a second pressure transducer disposed on the discharge line downstream of the discharge control valve and configured to collect second pressure data, wherein the parameters further comprise the discharge fluid density, the first pressure data, and the second pressure data; and wherein the method further comprises:

calculating a pressure differential across the discharge control valve using the first pressure data and the second pressure data; and calculating the flowrate of the discharge fluid based on the pressure differential and the discharge fluid density.

5. The automated sand evacuation system of claim 4, wherein the method further comprises:

determining the discharge sand quantity by subtracting a base fluid density from the discharge fluid density of the discharge fluid to determine a result; and multiplying the result by the discharge volume to determine a weight of the sand.

6. The automated sand evacuation system of claim 1, wherein the method further comprises controlling a cycle initiation time based on the discharge sand quantity.

7. The automated sand evacuation system of claim 1, wherein the method further comprises detecting a state change in the discharge fluid and controlling the discharge control valve to close based on the state change.

8. The automated sand evacuation system of claim 1, wherein the method further comprises:

detecting a state change in the discharge fluid and a state change time that the state change occurred; and updating the position setting and the time setting of the discharge control valve based on the state change time.

9. A method of quantifying sand in an evacuation cycle and controlling flow of a discharge fluid in an oil and gas well system, the method comprising:

obtaining, from a plurality of sensors, parameters indicative of the discharge fluid flowing in a discharge line, wherein the plurality of sensors comprises:

a first pressure transducer disposed upstream of a discharge control valve; and a second pressure transducer disposed downstream of the discharge control valve;

determining a pressure differential between a first pressure measured by the first pressure transducer and a second pressure measured by the second pressure transducer;

determining a flowrate of the discharge fluid based on the parameters and the pressure differential;

determining a discharge volume of the discharge fluid based on the flowrate;

determining a discharge sand quantity discharged during the evacuation cycle based on the discharge volume;

adjusting a position setting and a time setting for the discharge control valve based at least in part on the discharge sand quantity; and controlling the discharge control valve based on the position setting and the time setting.

10. The method of claim 9, wherein the plurality of sensors comprises a density meter and the parameters comprise a density of the discharge fluid; and wherein the method further comprises determining the flowrate of the discharge fluid further based on the density of the discharge fluid.

11. The method of claim 10, wherein the density meter is a non-radioactive non-invasive vibration-based percussive density meter.

12. The method of claim 11, wherein the discharge sand quantity is a weight of the sand discharged into a storage container.

13. The method of claim 12, further comprising:

determining a cycle initiation time for a next evacuation cycle;

controlling the discharge control valve to the position setting to initiate the next evacuation cycle; and closing the discharge control valve based on the time setting.

14. The method of claim 13, wherein a system pressure capacity is up to 10,000 pounds per square inch.

15. An automated sand evacuation system for automatically controlling sand and gas discharge of an oil and gas well system, the automated sand evacuation system comprising:

a plurality of interconnected pipes including a discharge line configured to move the sand from a sand separating vessel to a storage container;

a plurality of valves including a discharge control valve configured to allow a discharge fluid including the sand to flow through the plurality of interconnected pipes to the storage container when open and prevent the discharge fluid from flowing when closed;

a plurality of sensors configured to detect fluid parameters indicative of the discharge fluid;

a plurality of gas detecting sensors disposed at the storage container and configured to detect gas parameters indicative of the gas discharge from the discharge line; and one or more non-transitory computer-readable media storing computer-executable instructions that, when executed by at least one processor, perform a method of controlling flow of the discharge fluid, the method comprising:

obtaining the fluid parameters and the gas parameters from the plurality of sensors;

determining a discharge sand quantity discharged from the discharge line into the storage container;

determining a gas discharge quantity discharged from the discharge line; and controlling the discharge control valve based on the discharge sand quantity and the gas discharge quantity.

16. The automated sand evacuation system of claim 15, wherein the plurality of sensors comprises:

a first pressure transducer disposed upstream of the discharge control valve; and a second pressure transducer disposed downstream of the discharge control valve;

wherein the method further comprises:

determining a pressure differential between a first pressure measured by the first pressure transducer and a second pressure measured by the second pressure transducer;

determining the discharge sand quantity discharged during an evacuation cycle based at least in part on the pressure differential.

17. The automated sand evacuation system of claim 16, wherein the method further comprises:

determining a flowrate of the discharge fluid based on the fluid parameters, gas parameters, and the pressure differential;

determining a discharge volume of the discharge fluid based on the flowrate; and determining the discharge sand quantity based on the discharge volume.

18. The automated sand evacuation system of claim 15, wherein the method further comprises detecting a state change in the discharge fluid and controlling the discharge control valve to close based on the state change.

19. The automated sand evacuation system of claim 15, further comprising:

wherein the plurality of sensors comprises a density meter disposed on an exterior side of the discharge line, a production line, or a wellhead line, and configured to detect a discharge fluid density, wherein the fluid parameters comprise the discharge fluid density.

20. The automated sand evacuation system of claim 19, wherein the density meter is a non-radioactive non-invasive vibration-based percussive density meter.

* * * * *